United States Patent [19]

Iwasaki

[11] Patent Number: 4,922,883

[45] Date of Patent: May 8, 1990

[54] MULTI SPARK IGNITION SYSTEM

[75] Inventor: Shinichiro Iwasaki, Anjo, Japan

[73] Assignee: Aisin Seiki Kabushiki Kaisha, Kariya, Japan

[21] Appl. No.: 263,897

[22] Filed: Oct. 28, 1988

[30] Foreign Application Priority Data

Oct. 29, 1987 [JP] Japan ..... 62-274515

[51] Int. Cl.[5] ..... F02P 3/08; F02P 15/08

[52] U.S. Cl. ..... 123/598; 123/637; 123/656; 123/620

[58] Field of Search ..... 123/598, 605, 620, 637, 123/655, 656

[56] References Cited

U.S. PATENT DOCUMENTS

| | | | |
|---|---|---|---|
| 4,455,989 | 6/1984 | Endo et al. | 123/605 X |
| 4,589,398 | 5/1986 | Pate et al. | 123/598 X |
| 4,677,960 | 7/1987 | Ward | 123/598 |
| 4,696,280 | 9/1987 | Niggemeyer | 123/656 X |
| 4,733,646 | 3/1988 | Iwasaki | 123/597 |

*Primary Examiner*—Tony M. Agrenbright

*Attorney, Agent, or Firm*—Oblon, Fisher, Spivak, McClelland, Maier & Neustadt

[57] ABSTRACT

A multi spark ignition system using an ignition capacitor and an ignition transformer uses a device for providing charging energy to the ignition capacitor. A field effect discharge switching means is used for discharging the energy that is stored in the ignition capacitor through the primary winding of an ignition transformer. An oscillator is used for causing the discharging switching circuit to operate intermittently with a proper cycle. An additional controlling circuit controls the consumption of additional magnetic energy which is stored in the ignition transformer when it is in its non-operative state. Two returning means are used to consume the magnetic energy or for returning the energy and the ignition transformer under the non-operative and operative states of the discharge switching circuit.

4 Claims, 10 Drawing Sheets

MULTI SPARK IGNITION SYSTEM

BACKGROUND OF THE INVENTION

This invention relates to an ignition system for an internal combustion engine, and more particularly relates to a capacitive type ignition system.

A multi spark ignition system which generates a series of ignition sparks within a demanded firing duration is well known in the art.

An typical conventional ignition system is shown in FIG. 17. The conventional ignition system comprises a charging circuit (100), an ignition capacitor (101), an ignition transformer (102), a spark plug (103) and a discharging circuit (104). This discharging circuit (104) further includes a transistor (107) and an oscillator (106).

Furthermore, a first returning circuit (105) which comprises a resistor (108) and a diode (109) is connected to a primary winding of the ignition transformer (102) so as to absorb a high voltage generated on the primary winding when the discharging circuit (104) turns off.

In this ignition system, an ignition spark may be generated at the certain moment when the transistor (107) turns on. Further, the transistor (107) turns on and off repeatedly with a cycle determined by the oscillator (106). As a result, the conventional ignition system can generate a series of ignition sparks with the cycle determined by the oscillator (106) within a demanded firing duration of the internal combustion engine.

Now, a process for generating the ignition spark is explained in detail.

When the transistor (107) turns on, the capacitive energy charged in the ignition capacitor (101) will be discharged through the primary winding of the ignition transformer (102). At this time, one part of the capacitive energy will be stored in the ignition transformer (102) as a magnetic energy. At the same time, the other part of the capacitive energy charged in the ignition capacitor (101) will be transmitted to the spark plug (103) through a secondary winding of the ignition transformer (102), and then, the ignition spark will be generated at the spark plug (103).

After generating the ignition spark, the transistor (107) turns off. When the transistor (107) turns off, the magnetic energy stored in the ignition transformer (102) circulates the first returning circuit (109) and primary winding of the ignition transformer (102) as an electric current, and is consumed by the resistor (108) partially.

While the magnetic energy stored in the ignition transformer (102) circulates the first returning circuit (109) and primary winding of the ignition transformer (102), the magnetic energy is converted into heat by the resistor (108). At this time, if a resistance of the resistor (108) is established in small value, the magnetic energy stored in the ignition transformer (102) may be discharged mainly through secondary winding of the ignition transformer (102), because the resistor (108) does not consume the magnetic energy so much. The discharged energy though the secondary winding is going to generate the ignition spark. Accordingly, if the resistance of the resistor (108) is established as a small value, a period for holding a single spark could be elongated after the transistor (107) turns off.

After the magnetic energy stored in the ignition transformer (102) is reduced in such level where the ignition spark can not be maintained, the energy discharged through the secondary winding is disappeared, then the magnetic energy remained in the ignition transformer (102) is consumed by the resistor (108) only. However, if the resistance of the resistor (108) is established in small value, the electric current flows through the first returning circuit (109) and the primary winding for a while.

Meanwhile, the transistor (107) should be turned on after the electric current through the first returning circuit (109) and primary winding completely disappears, i.e. after the magnetic energy stored in the ignition transformer (102) disappears completely, in order to generate the uniformed ignition sparks because of the non-symmetric wave form of the A.C. voltage applied to the ignition transformer (102) from the ignition capacitor (101). Otherwise, whenever the transistor (107) turns on, an exciting current of the ignition transformer is increased gradually, and thus the period for maintain the single ignition spark will be reduced. In fact, if the transistor (107) is turned on independently from the current through the first returning circuit (109) and primary winding, the ignition transformer (102) may be saturated magnetically, thus the ignition spark should stop generating.

Accordingly, if the resistance of the resistor (108) should be established in small value, the cycle of the oscillator (106) must be selected long sufficiently in order to completely disappear the current through the first returning circuit (109) and primary winding.

As described above, if the resistance of the resistor (108) is established in small value, the period for maintaining the single ignition spark can be elongated but a interval of time between two independent ignition sparks must be elongated.

Contrary, if the resistance of the resistor (108) is established as a large value, the current through the first returning circuit (105) and primary winding disappears immediately, because the resistor (108) consumes the magnetic energy. Accordingly, if the resistance of the resistor (108) is selected as a large value, the interval of time between the two independent ignition sparks can be reduced. However, the period for maintaining the ignition spark must be reduced, because the energy discharged through the secondary winding is also reduced.

Thus, the conventional ignition system can not obtain a series of ignition spark having the elongated maintain time as well as the reduced interval of time between the two independent sparks at the same time.

SUMMARY OF THE INVENTION

Accordingly, one of the object of this invention is to obviate the conventional drawbacks.

Further, one of the object of this invention is to be consistent elongated maintaining time of the sparks produced while still having a reduced interval between two independent sparks.

To achieve the above objects, and in accordance with the principles of this invention as embodied and broadly described herein, the ignition system comprises a charging means for charging energy in a ignition capacitor, discharge switching means for discharging the energy in the ignition capacitor through the primary winding of an ignition transformer, an oscillator means for making the discharging means operate intermittently with a proper cycle and controlling means for making the oscillator means operate within a demanded firing duration comprises a first returning means for consuming a magnetic energy stored in the ignition transformer under non-operative state of the discharge switching means, and a second returning means for returning the energy stored in the ignition transformer and discharging the energy through the secondary winding under operative state of the discharge switching means.

Preferably, the charging means includes a DC-DC converting means for generating a high D.C. voltage, a capacitor means connected to the output of the DC-DC converting means, and charge switching means for charging the ignition capacitor in response to the operation of the controlling means.

The above and the other objects, features and advantages of this invention will become more apparent from the following description.

BRIEF DESCRIPTION OF THE DRAWINGS

The accompanying drawings, which are incorporated in and constitute a part of the specification, illustrate an embodiment of the invention, serve to explain the principles of the invention. Of the drawings.

DETAILED DESCRIPTION OF THE PREFERRED EMBODIMENT

Figure 1:
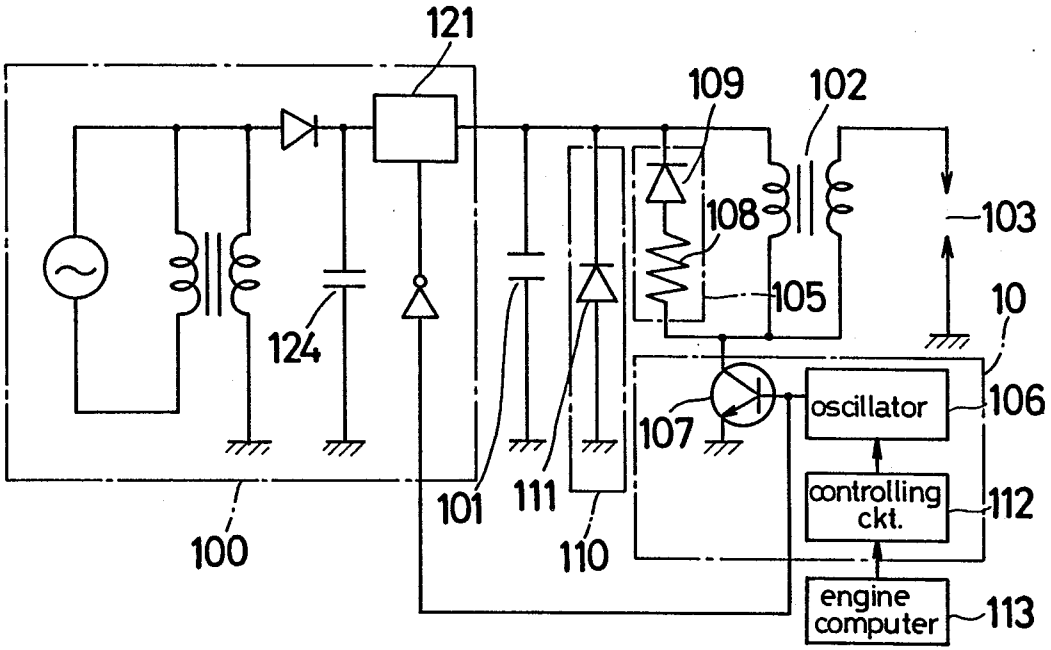
FIG. 1 is a circuit diagram showing the operating circuit elements as well as their interconnections according to the present invention.

FIG. 1 is a circuit diagram showing a preferable first embodiment of this invention. In the first embodiment, a resistance of the resistors (108) in the first returning circuit (109) is selected as a large value. Further, a diode (111) is connected to an ignition capacitor (101) in parallel in the first embodiment. The diode (111) constitutes the second returning circuit (110). Furthermore, an oscillator (106) is controlled by controlling circuit (112) and an engine computer (113). A charging circuit (100) includes a charge switching circuit (121) and a huge capacitor (124). The charge switching circuit (121) turns on and connects the huge capacitor (124) to the ignition capacitor (101) while a transistor (107) turns off. Contrary, the charge switching circuit (121) turns off while the transistor (107) turns on.

By the way, an ignition transformer (102) is a typical step-up transformer and turn ratio of the ignition transformer (102) is established as 1:100. Although the ignition transformer (102) is connected to a spark plug (103) directly in the first embodiment, a distributor may be interconnected between the ignition transformer (102) and the spark plug (103).

Figure 17:
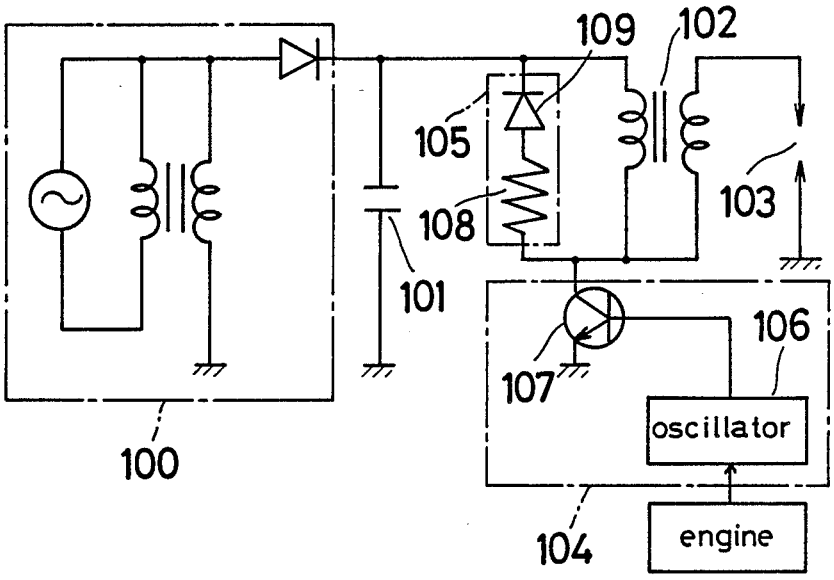
FIG. 17 PRIOR ART
FIG. 17 is a circuit diagram showing the conventional ignition system.

The other interconnection and elements are the same as the conventional ignition system showing in FIG. 17. Accordingly, a detailed explanation will be omitted from this specification.

Figure 2:
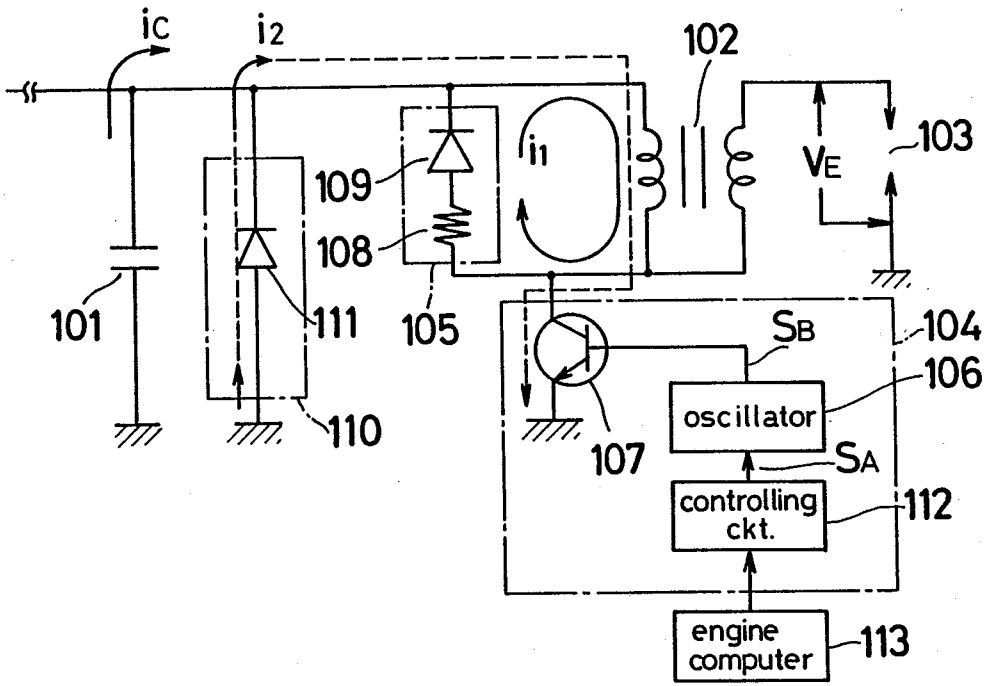
FIG. 2 is a circuit diagram showing operations of first and second returning circuits disclosed in FIG. 1.
Figure 3:
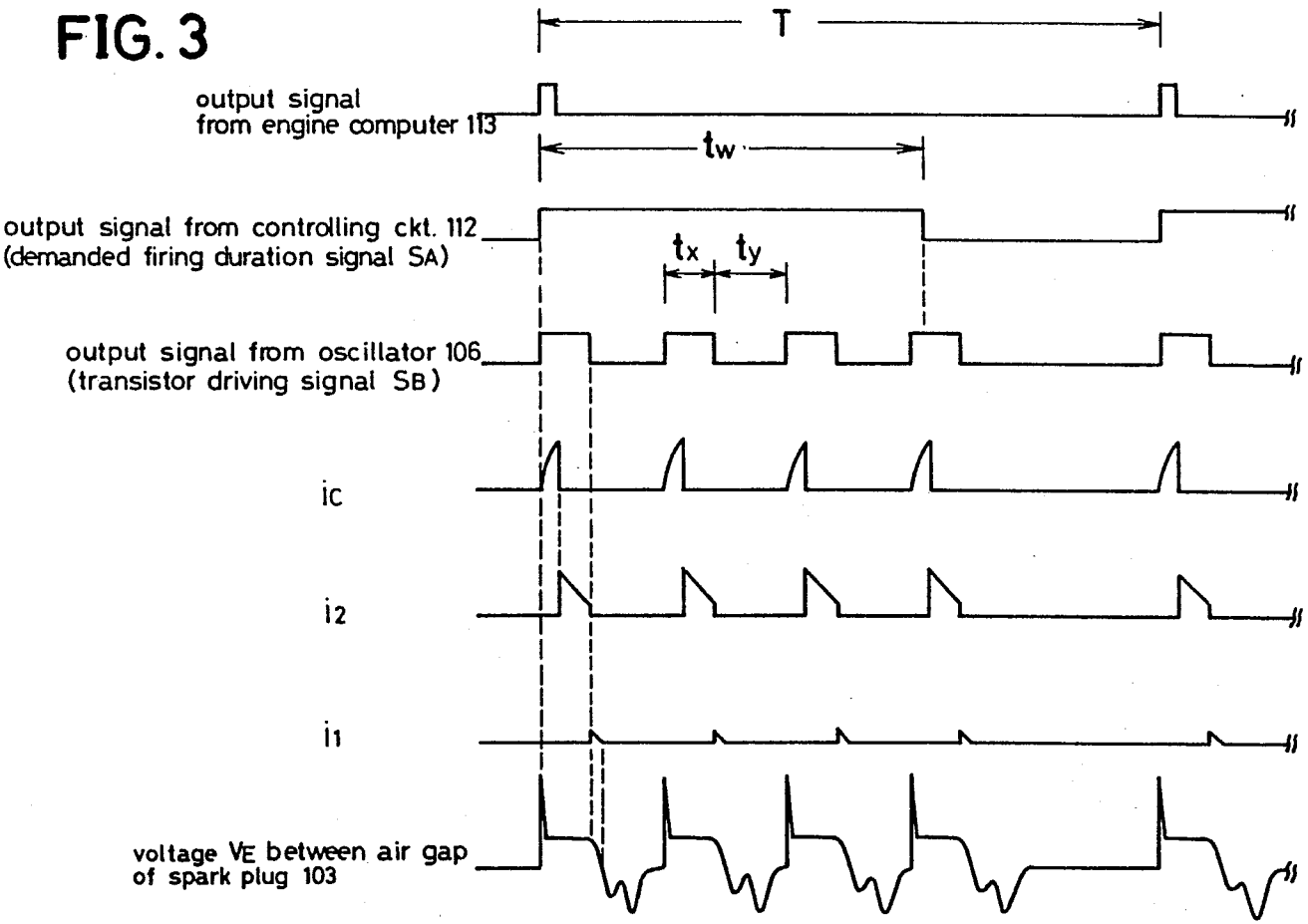
FIG. 3 provides a series of curves showing the voltage and the current characteristics at various selected places throughout the circuitry of FIG. 2.

Referring to FIGS. 2 and 3, an operation of the first embodiment will be explained.

As shown in FIG. 3, the engine computer (113) discriminates a proper firing timing based on a load of the engine, a position of a throttle valve and rotational speed of the engine etc., and generates a series of pulses which expresses very start of a demanded firing duration ($t_w$). In the following explanation, an interval of time between these two independent pulses is defined as a firing cycle (T).

Figure 4:
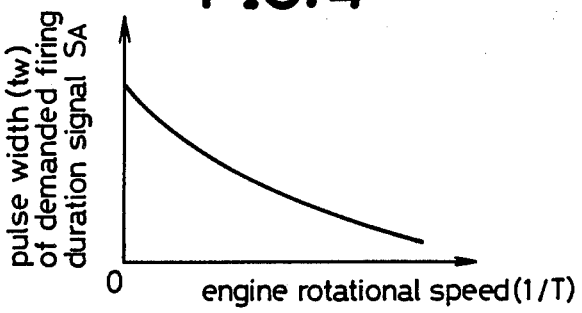
FIG. 4 is a graph showing a characteristic of the controlling circuit disclosed in FIGS. 1 and 2.

The controlling circuit (112) generates a demanded firing duration signal ($S_A$) in response to the pulses from engine computer (113). In the following explanation, the demanded firing duration ($t_w$) is defined as a time when the demanded firing duration signal ($S_A$) is generated. Accordingly, the controlling circuit (112) calculates the engine rotational speed (1/T) based on the firing cycle (T) and determines the demanded firing duration ($t_w$) FIG. 4 is a graph showing a characteristic of the controlling circuit (112). The demanded firing duration ($t_w$) is established basically in inverse proportion to the engine rotational speed (1/T). Further, the characteristics of the controlling circuit (112) can be varied by various signal from external equipment (not shown) such as engine load sensor or throttle valve position sensor etc.

Figure 5:
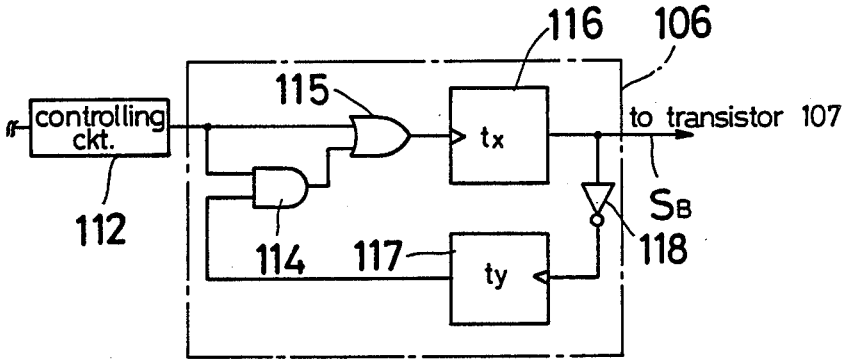
FIG. 5 is a circuit diagram showing the details of oscillator disclosed in FIGS. 1 and 2.

The oscillator (106) oscillates with a predetermined cycle, and generates a transistor driving signal ($S_B$) while the demanded firing duration signal ($S_A$) is generated. FIG. 5 is a circuit diagram showing the details of oscillator (106). The oscillator (106) comprises an "AND" gate (114), an "OR" gate (115) and mono-stable multi-vibrators (116, 117). Each of the multi-vibrators (116, 117) is triggered in response to a very rising edge of input signal. The multi-vibrator (116) determines a discharging period of time ($t_X$) and the multi-vibrator (117) determines a charging period of time ($t_Y$) The output signal from the oscillator (106) is applied to a base terminal of the transistor (107) and has the transistor turn on and off repeatedly.

As shown in FIG. 2, a discharging current ($i_c$) flows out from the ignition capacitor (101) as soon as the transistor (107) turns on. The discharging current ($i_c$) flows through the primary winding of the ignition transformer (102) and the transistor (107). At this time, the ignition capacitor (102) and the ignition transformer (102) constitutes an "LC resonance circuit". Accordingly, after the transistor (107) turns on, the discharging current ($i_c$) is increased in accordance with the resonant cycle of the "LC resonance circuit", and is maximized when the capacitive energy in the ignition capacitor (101) is completely discharged. After the discharging current ($i_c$) is maximized, a discharging current ($i_2$) flows out from the ignition transformer (102). The discharging current ($i_2$) is generated by discharging the magnetic energy stored in the ignition transformer (102). The discharging current ($i_2$) does not re-charge the ignition capacitor (101) but flows through the diode (111) of the second returning circuit (110). At this time, the magnetic energy stored in the ignition transformer (102) is almost discharged through the secondary winding of the ignition transformer (102) and is consumed as the ignition spark generated on the spark plug (103).

A voltage ($V_E$) generated between the air gap provided on the spark plug (103) is shown in the FIG. 3. A high voltage is generated on the spark plug (103) as soon as the transistor driving signal ($S_B$) is generated. After the discharging current ($i_c$) disappears, the generated high voltage continues until the magnetic energy stored in the ignition transformer (102) is almost discharged.

Meanwhile, in this first embodiment, the discharging period ($t_x$) of the multi-vibrator (116) is determined so as to discharge the magnetic energy in the ignition transformer (102) almost. Accordingly, the period ($t_x$) of the multi-vibrator (116) is determined shorter than the time when the ignition spark on the spark plug (103) disappears naturally because of the reduction of the stored magnetic energy in the ignition transformer (102). Therefore, the high voltage is generated on the spark plug (103) as soon as the transistor driving signal ($S_B$) is generated, and the generated high voltage continues until the transistor driving signal ($S_B$) disappears. In other words, the ignition spark is generated on the spark plug (103) continuously while the transistor driving signal ($S_B$) is generated.

Referring again to FIG. 2, an operation of the first returning circuit (105) is explained. A discharging current ($i_1$) flows out instead of the discharging current ($i_2$) when the transistor driving signal ($S_B$) disappears and the transistor (107) turns off. The discharging current ($i_1$) flows through the resistor (108) and the diode (109) of the first returning circuit (105). At this time, the magnetic energy remained in the ignition transformer (102) is consumed by the resistor (108), and is converted into heat. In this first embodiment, the remained magnetic energy in the ignition transformer (102) disappears immediately, because the resistance of the resistor (108) is selected large value. As a result, the discharging current ($i_1$) is disappears in a short period.

As shown in FIG. 3, the voltage ($V_E$) does not stabilize for a while, after the discharging current ($i_1$) disappears. However, the voltage ($V_E$) returns to normal condition, i.e. 0 (v), while the charging period ($t_y$) of the multi-vibrator (117).

Thus, in the ignition system according to the first embodiment, the second returning circuit (110) is operated while the transistor (107) turns on, and the maintaining period of the ignition spark is elongated. Contrary, the first returning circuit (105) is operated while the transistor (107) turns off, and the ignition transformer (102) is initialized immediately. Therefore, in the ignition system according to the first embodiment, the series of the ignition sparks having an elongated maintaining time can be obtained, and also the interval of time between two independent ignition sparks can be minimized.

Figure 6:
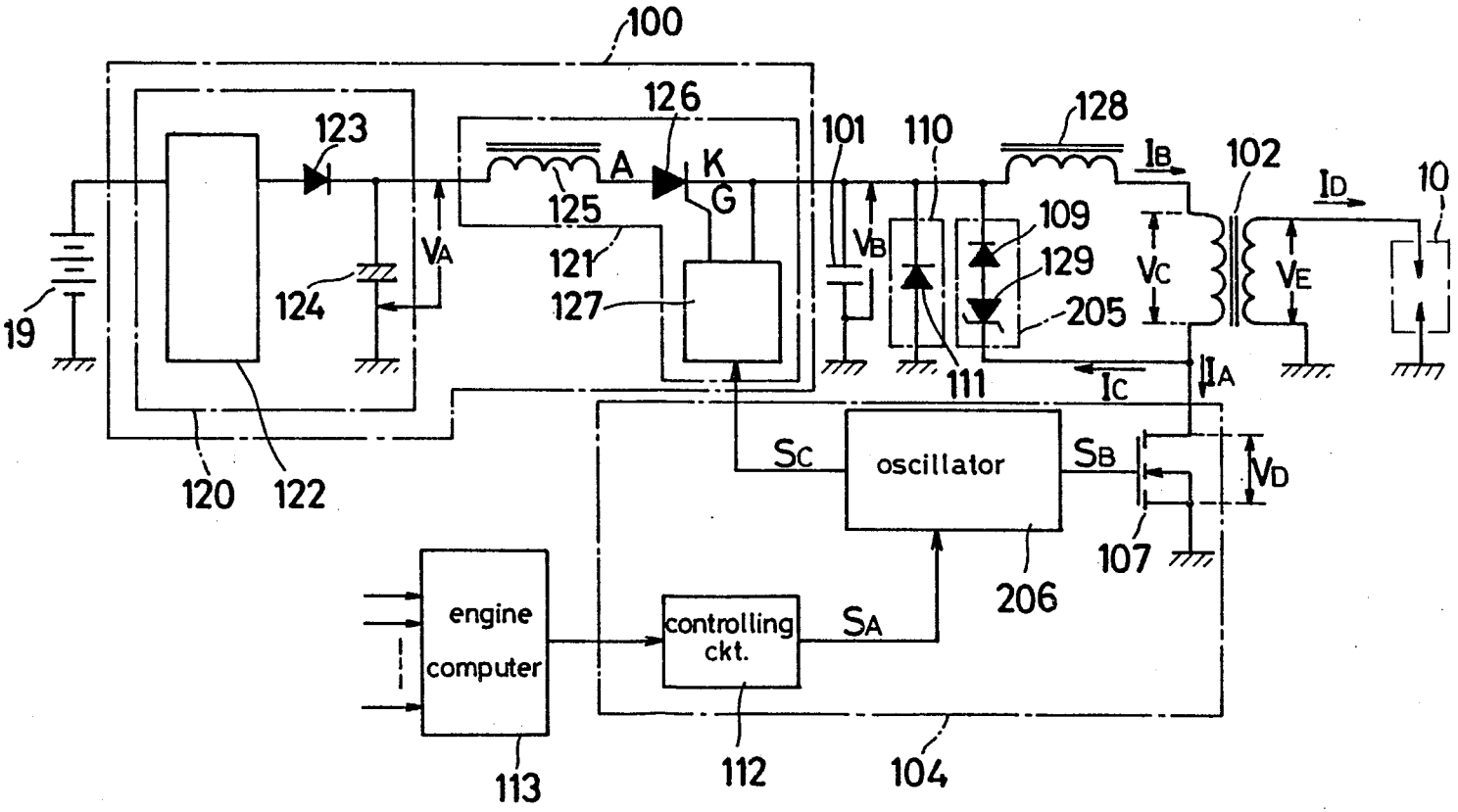
FIG. 6 is a circuit diagram set forth a modified embodiment of this invention.

Referring now to FIG. 6, the second embodiment is explained. An ignition system according to the second embodiment is an improved or expanded system from the first embodiment. In the second embodiment, the charging circuit (100), the discharging circuit (104) and the first returning circuit (205) are improved. Further, a choke coil (128) is provided between the ignition capacitor (101) and ignition transformer (102). The other construction is substantially the same as the first embodiment, and therefore, a detail explanation is omitted from the following explanation.

Now, the improved charging circuit (100) is explained. The improved charging circuit (100) comprises a DC-DC converter (120) having a huge capacitor (124) and a charge switching circuit (121). A D.C. voltage with 12 (v) from a battery (119) is boosted by the DC-DC converter (120), and applied to the charge switching circuit (121).

The DC-DC converter (120) comprises a ringing converter (122), a diode (123) and a huge capacitor (124) with about 220 ($\mu$F). The ringing converter (122) converts and boosts the D.C. voltage from the battery (119) into high A.C. voltage with about 200–250(v). The output voltage from the ringing converter (122) is rectified by the diode (123), then charges the huge capacitor (124). As a result, the output voltage (VA) becomes about D.C. 200–250 (v).

The charge switching circuit (121) comprises a choke coil (125) with 100 ($\mu$H), a thyristor (126) and thyristor driving circuit (127). A gate terminal and a cathode terminal of the thyristor (126) are connected to the thyristor driving circuit (127). Further, the cathode terminal of the thyristor (126) is connected to the ignition capacitor (101). The thyristor (126) is turned on by the thyristor driving circuit (127), and continues the on state until the ignition capacitor (101) is completely charged, i.e. the current flowing through the thyristor (126) is less than the holding current of the thyristor (126).

While the thyristor (126) turns on, the huge capacitor (124), choke coil (125) and ignition capacitor (101) constitute a "LC resonance circuit", and one part of the capacitive energy charged in the huge capacitor (124) is charged in the ignition capacitor (101). At this time, almost twice as much as the output voltage ($V_A$), i.e. about 400 (v), is charged in the ignition capacitor (101). Thus, a unit of capacitive energy corresponding to a single ignition spark is charged in the ignition capacitor (101). The charging circuit (100) according to the second embodiment can charge the ignition capacitor (101) within a small period of time, i.e. less than about 20 ($\mu$s), after the thyristor (126) turns on.

Figure 7:
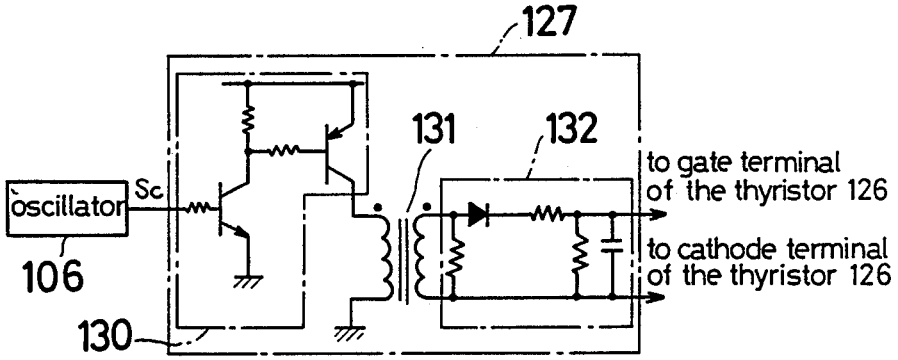
FIG. 7 is a circuit diagram of the thyristor driving circuit disclosed in FIG. 6.

FIG. 7 is a circuit diagram of the thyristor driving circuit (127). The thyristor driving circuit (127) comprises a buffer amplifier (130), a pulse transformer (131), and a waveform shaper (132). The thyristor driving circuit (127) insulates the oscillator (106) from the thyristor (126). The thyristor driving signal ($S_c$) fed from the oscillator (106) is amplified by the buffer amplifier (130), and is applied to a primary winding of the pulse transformer (131). Further, a gate driving circuit (132) is connected to a secondary winding of the pulse transformer (132). The gate driving circuit (132) applies the thyristor driving signal ($S_c$) from the pulse transformer (131) between the cathode terminal and gate terminal of the thyristor (126).

Referring again to FIG. 6, the discharging circuit (104) is explained. The discharging circuit (104) comprises a controlling circuit (112), an oscillator (104) and a Field Effect Transistor (107). As to the controlling circuit (112), a detail explanation is omitted because the the controlling circuit (112) is the same as the first embodiment.

Figure 8:
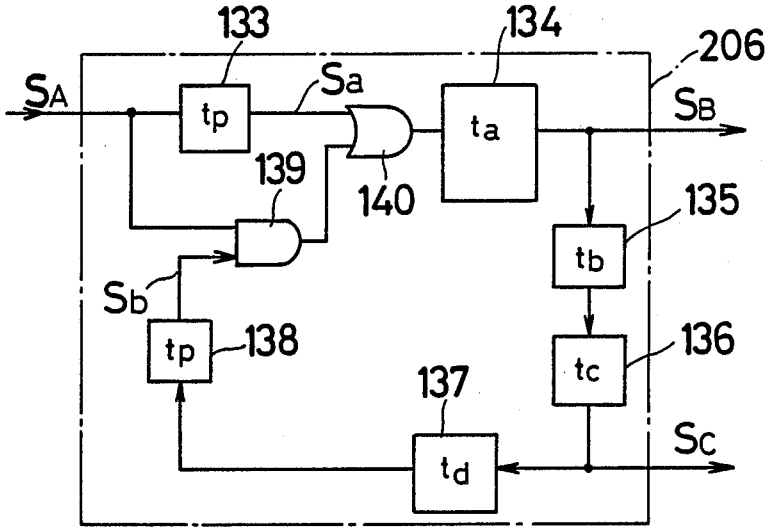
FIG. 8 is a circuit diagram of the oscillator disclosed in FIG. 6.
Figure 9:
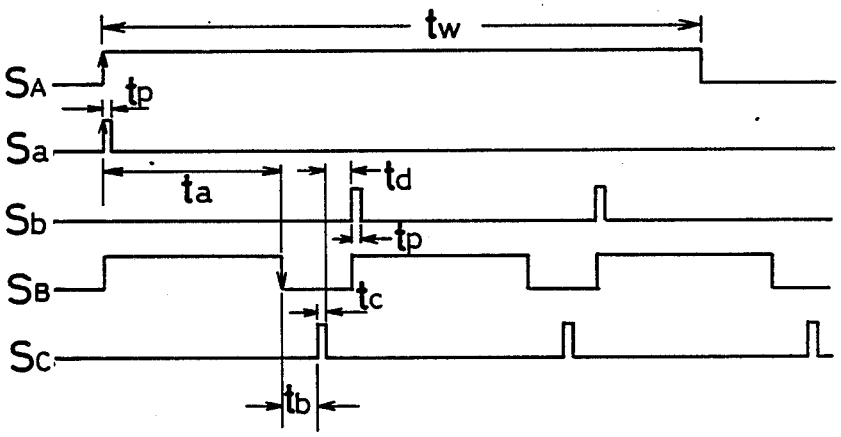
FIG. 9 provides a series of curves showing the voltage characteristics at various selected places throughout the circuitry of FIG. 8.
Figure 10:
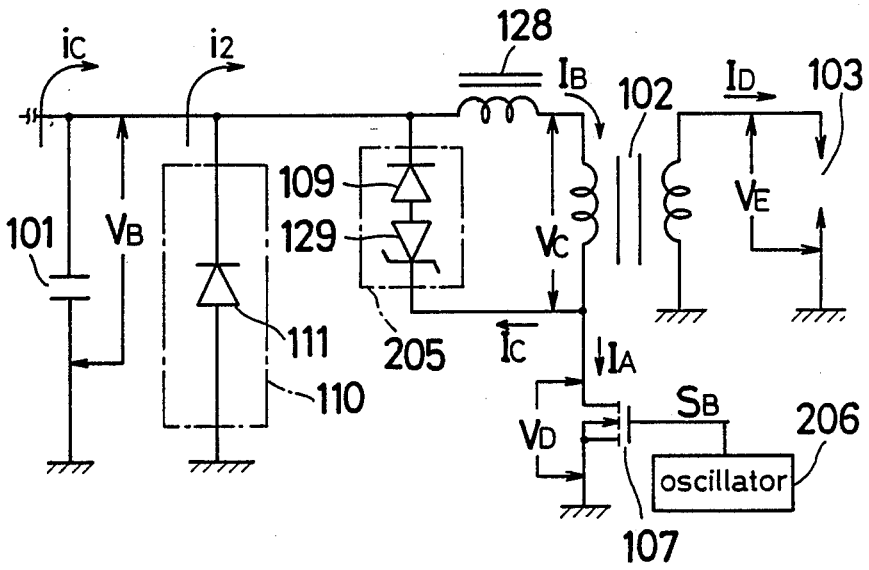
FIG. 10 is a circuit diagram showing an operations of first and second returning circuits disclosed in FIG. 6.

Referring now to FIGS. 8 and 9, a construction and an operation of the oscillator (206) is explained. FIG. 8 is a circuit diagram of the oscillator (206). Further, FIG. 9 provides a series of curves showing characteristics at various selected places in the oscillator (206). The oscillator (206) oscillates with predetermined cycle during the demanded firing duration, and generates the thyristor driving signal ($S_c$). The oscillator (206) comprises six mono-stable multi vibrators (133, 134, 135, 136, 137, 138), "AND" gate (139) and "OR" gate (140). Determined periods of time and trigger types of the six monostable multi vibrator (133–138) are shown in table 1.

TABLE 1

| multi vibrator | determined period | trigger type |
|---|---|---|
| 133 | $t_p$ | up-edge |
| 134 | $t_a$ | down-edge |
| 135 | $t_b$ | down-edge |
| 136 | $t_c$ | down-edge |
| 137 | $t_d$ | down-edge |
| 138 | $t_p$ | up-edge |

As shown in FIG. 9, the oscillator (206) oscillates with the predetermined cycle which is determined by sum of four determined periods ($t_a$, $t_b$, $t_c$, $t_d$) of multi vibrators (134–137), and generates the transistor driving circuit ($S_B$) and the thyristor driving circuit ($S_c$).

When the demanded firing duration signal ($S_A$) is applied to the oscillator (206), the multi vibrator (133) is triggered. At this time, the multi vibrator (133) generates an output signal ($S_a$) for determined period ($t_p$). The multi vibrator (133) has the multi vibrator (134) trigger more reliably, and also has an output from the "OR" gate (140) determines more stably. The determined period ($t_p$) of the multi vibrator (134) is established shorter than the period ($t_a$) of the multi vibrator (134).

When the output signal ($S_A$) is applied to the multi vibrator (134) through the "OR" gate (140), the multi vibrator (134) is triggered. At this time, the multi vibrator (134) generates the transistor driving signal ($S_B$) for the determined period ($t_a$). The determined period ($t_a$) of the multi vibrator (134) is determined based on the magnetic energy stored in the ignition transformer (102) and the choke coil (101) in order to define the discharging period ($t_x$).

The transistor driving signal ($S_B$) is also applied to the multi vibrator (135). The multi vibrator (135) is triggered as soon as the transistor driving signal ($S_B$) disappears. The multi vibrator (135) triggers the multi vibrator (136) after the determined period ($t_b$) is expired. The multi vibrator (136) generates the thyristor driving signal ($S_c$) for the determined period ($t_c$). The multi vibrator (136) has the thyristor (126) turn on through the thyristor driving circuit (127). The determined period ($t_c$) of the multi vibrator (136) is established based on a turn on time of the thyristor (126).

The thyristor driving signal ($S_c$) is also applied to the multi vibrator (137). The multi vibrator (137) is triggered when the thyristor driving signal ($S_c$) disappears. The multi vibrator (137) triggers the multi vibrator (138) after the determined period ($t_d$) is expired. When the multi vibrator (138) is triggered, if the demanded firing duration signal ($S_A$) is applied continuously, the output signal ($S_b$) from the multi vibrator (138) is applied to the multi vibrator (134) through the "AND" gate (139) and "OR" gate (140). Then, the multi vibrator (134) is triggered again, and the second transistor driving signal ($S_B$) is generated.

Meanwhile, the multi vibrator (137) prevents the transistor driving signal ($S_B$) from generating until the thyristor (126) turns off. The determined period of the multi vibrator (137) is established in order to charge the ignition capacitor (101) sufficiently. Further, the period ($t_p$) of the multi vibrator (138) is established shorter than the period ($t_a$) so as to trigger the thyristor reliably and to determine the outputs from the "AND" gate (139) and the "OR" gate (140) stably.

As described above, the oscillator (206) generates the transistor driving signal ($S_B$) and the thyristor driving signal ($S_c$) with predetermined cycle which is established by the sum of the determined periods ($t_a$, $t_b$, $t_c$, $t_d$) of the multi vibrator (134–137), while the demanded firing duration signal ($S_A$) is applied to the oscillator (206).

Referring again to FIG. 6, the first returning circuit (205) is explained. In the second embodiment, a zener diode (129) is used in the first returning circuit (205). Accordingly, the first returning circuit (205) constitutes a clamp circuit. Therefore, the voltage between the terminals of the first returning circuit (205) is clamped to almost same voltage. As a result, A drain voltage ($V_D$) is controlled in a proper range less than a clamped voltage. In the second embodiment, the clamped voltage (205) is established in high voltage, which is about 40–70 (v).

Finally, the choke coil (128) is explained. The choke coil (128) is connected between the ignition capacitor (101) and the ignition transformer (102). The choke coil (128) has about 1 (mH) of inductance. When the transistor (107) turns on, the ignition capacitor (101), the choke coil (128) and ignition transformer (102) constitute the "LC resonance circuit", The choke coil (128) limits the electric current toward the ignition transformer (102) from the ignition capacitor (101) because the choke coil (128) elongates the resonance cycle of the "LC resonance circuit". In the second embodiment, a pulse transformer is used as the ignition transformer (102) because the choke coil (128) is connected to the ignition capacitor (101). The pulse transformer has the following three characters:

(a) an exciting current is small.
(b) a magnetic coupling between primary winding and secondary winding is good.
(c) an external size is small.

Accordingly, an external size of the ignition system may be reduced if the pulse transformer is used as the ignition transformer (102). Further, the ignition transformer (102) can be disposed nearby the ignition plug (103) because the ignition transformer (102) becomes small. If the ignition transformer (102) is disposed near by the ignition transformer (102), a length of the connecting cable between the ignition transformer (102) and the ignition plug (103) can be reduced. Accordingly, a loss of the energy through the connecting cable can be reduced. By the way, the reduction ratio between the primary and secondary windings of the ignition transformer (102) is established in 1:100 in this second embodiment. Further, it is capable for this second embodiment to interconnected the distributer between the ignition transformer (102) and the ignition plug (103).

Figure 12:
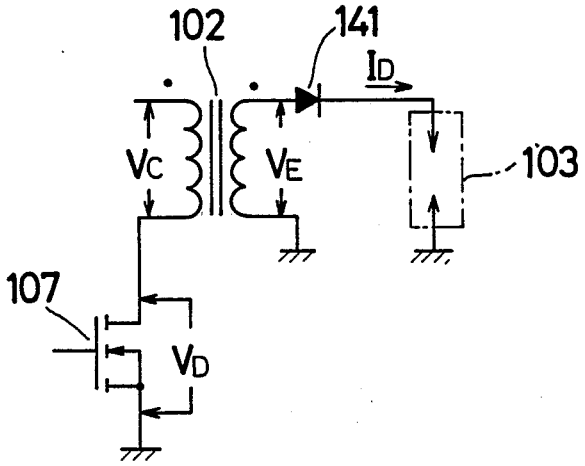
FIG. 12 is a circuit diagram set forth the other modified embodiment of this invention.
Figure 11:
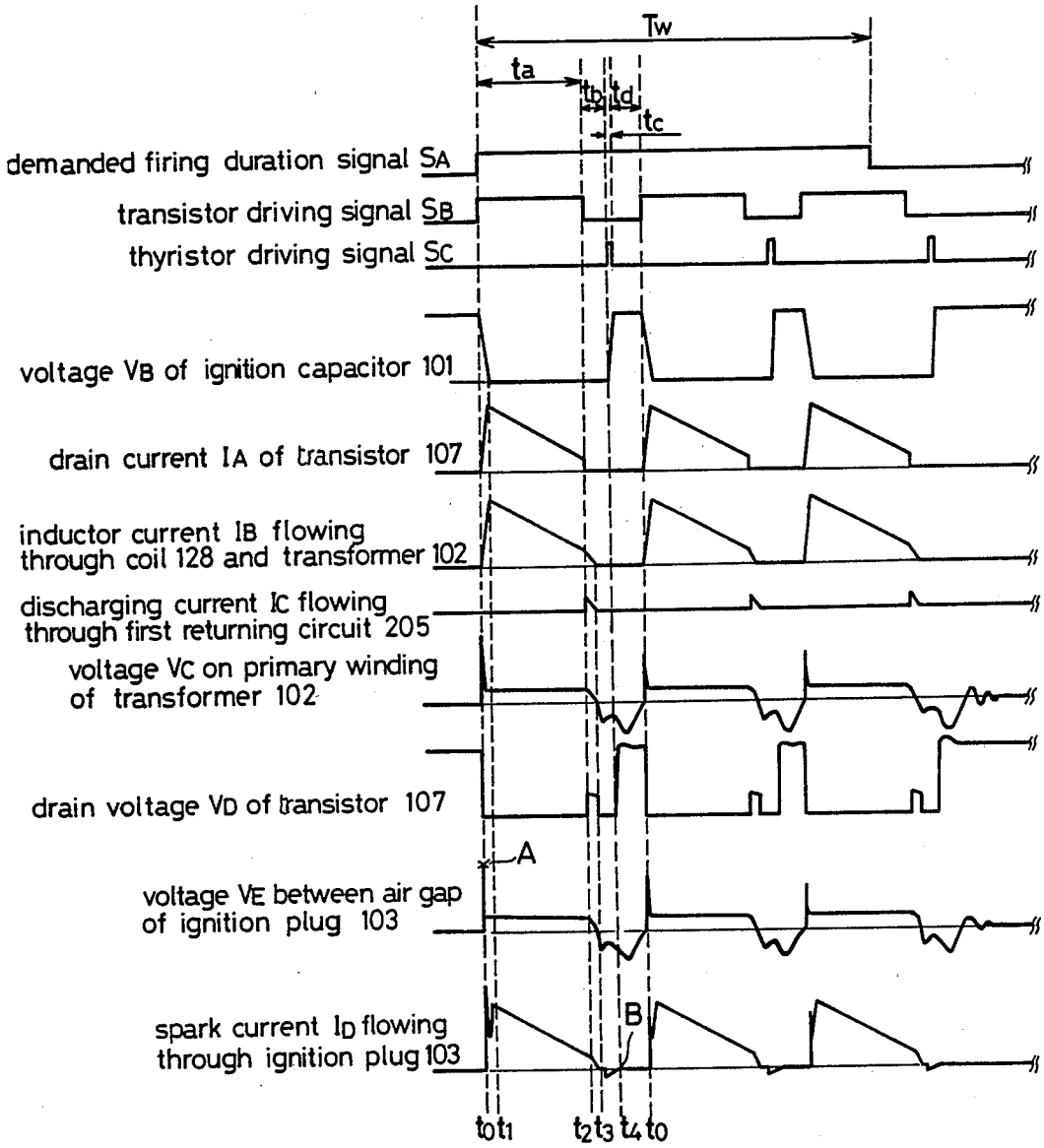
FIG. 11 provides a series of curves showing the voltage and current characteristics at various selected places throughout the circuitry of FIG. 10.

Referring now to FIGS. 11 and 12, an operation of the second embodiment is explained.

First of all, the operation which appears in the primary winding side of the ignition transformer (102) is explained. The oscillator (206) generates the transistor driving signal ($S_B$) and the thyristor driving signal ($S_C$) alternatively and repeatedly, while the demanded firing duration signal ($S_A$) is fed from the controlling circuit (112). When the transistor driving signal ($S_B$) is generated, the transistor (107) turns on, and the discharging current ($i_c$) from the ignition capacitor (101) flows out. The discharging current ($i_c$) corresponds to the drain current ($I_A$) from a moment ($t_0$) to the other moment ($t_1$). While the drain current ($I_A$) is flowing out, the capacitive energy in the ignition capacitor (101) is reduced, and the voltage ($V_B$) generated on the terminals of the ignition capacitor (101) is also reduced gradually. When the voltage ($V_B$) becomes 0 (v) at the moment ($t_1$), the drain current ($I_A$) is maximized. In this period between the moment ($t_0$) and the other moment ($t_1$), a part of the capacitive energy charged in the ignition capacitor (101) is converted into the ignition spark. At the same time, the other part of the capacitive energy charged into the ignition capacitor (101) is stored in the ignition transformer (102) and the choke coil (128) as a magnetic energy.

After a moment ($t_1$), the magnetic energy stored in the ignition transformer (102) and the choke coil (128) is discharged, and the discharging current ($i_2$) is generated. The magnetic energy which is stored in the ignition transformer (102) and the choke coil (128) do not recharge the ignition capacitor (101) but discharge through the second returning circuit (110). The discharging current ($i_2$) corresponds to the inductor current ($I_B$) between a moment ($t_1$) and the other moment ($t_2$). While the inductor current ($I_B$) is flowing out, the magnetic energy stored in the ignition transformer (102) and the choke coil (128) is reduced, and the inductor current ($I_B$) is also reduced gradually.

When the transistor (107) turns off at the moment ($t_2$), the remained magnetic energy in the ignition transformer (102) and the choke coil (128) is discharged as the discharging current ($I_c$) through the first returning circuit (205). At this time, the magnetic energy is converted into the ignition spark partially, but is consumed and converted into heat mainly by the first returning circuit (205). As a result, the magnetic energy remained in the ignition transformer (102) and the choke coil (128) disappears until a moment ($t_3$).

When the thyristor (126) turns on at a moment ($t_4$), the ignition capacitor (101) is charged and the voltage ($V_B$) rises up.

Meanwhile, in this second embodiment, there are some capability where a high voltage is generated on the drain voltage ($V_B$) within the charging period of the ignition capacitor (101) from the moment ($t_4$) to the moment ($t_0$). Because, if both the determined period (ta) of the multi vibrator (134) and the determined period (tb) of the multi vibrator (135) are established too small, there are some capability where the charging voltage of the ignition capacitor (101), i.e. the output voltage ($V_A$) from the DC-DC converter (120), and the clamped voltage of the returning circuit (205) are added to the drain terminal of the transistor (107). Accordingly, in the second embodiment, the transistor (107) has a proper breakdown voltage which is higher than the sum of the output voltage from the DC-DC converter (120) and clamped voltage of the first returning circuit (205). However, in this second embodiment, the selection of the transistor (107) is easy because the sum of the output voltage ($V_A$) and clamped voltage is at most about 470 (v).

Next, the operation of this embodiment which appears in the secondary winding side of the ignition transformer (102) is explained. When the transistor (107) turns on between the moment (t0) and the moment (t1), the drain current ($I_A$) flows through the transistor (107). At the same time, the inductor current ($I_B$) flows through the ignition transformer (102). The inductor current ($I_B$) induces the spark current ($I_D$) through the secondary winding of the ignition transformer (102). The spark current ($I_D$) charges a stray capacitor which exists on the secondary winding side, and increase the voltage ($V_E$) between the air gaps of the spark plug (103). When the voltage ($V_E$) exceeds the breakdown voltage of the spark plug (103), i.e. "A" point in the FIG. 11, the ignition spark is generated on the ignition plug (103). After the ignition spark is generated, the voltage ($V_E$) is dropped rapidly to the maintaining voltage about 1000–3000 (v). The voltage ($V_E$) is maintained at the maintaining voltage between the moment ($t_1$) and the moment ($t_2$).

When the transistor (107) turns off at the moment ($t_2$), the magnetic energy, which is remained in the ignition transformer (102) and the choke coil (128) within the period from the moment (t2) to the moment (t3), is consumed at the first returning circuit (205) and spark plug (103). While the ignition spark is generated, the voltage ($V_E$) is dropped in response to the reduction of the magnetic energy. The ignition spark which is generated on the spark plug (103) disappears when the voltage ($V_E$) becomes less than the maintaining voltage.

Thus, in this second embodiment, the maintaining period for the ignition spark is elongated by the second returning circuit (110), while the transistor (107) turns on. Contrary, the ignition transformer (102) is initialized immediately by the first returning circuit (205). Accordingly, in this second embodiment, the cycle of the oscillator (106) can be established in short, and a series of ignition sparks can be generated with small interval of time. Further, The drain voltage ($V_D$) can be sustained less than the proper voltage, because the zener diode (129) is used in the first returning circuit (205). Therefore, the endurance of the transistor (107) can be improved, thus the reliability of the ignition system might rise up.

FIG. 12 is a circuit diagram set forth the third embodiment which modifies the second embodiment. In the third embodiment, a diode (141) is interconnected between the ignition transformer (102) and the spark plug (103). The diode (141) prevents the reverse current (B) of the spark current ($I_D$) shown in the FIG. 11 from generating. The other construction of the third embodiment is the same as the second embodiment shown in FIG. 6. Therefore, detailed explanation is omitted.

The remained magnetic energy in the ignition transformer (102) is not consumed in the secondary winding side of the ignition transformer but is consumed by only the first returning circuit (205) if the diode (141) is interconnected. Accordingly, in the third embodiment, the interval of time for the initializing the ignition transformer can be controlled by defining the clamped voltage. Accordingly, in the third embodiment, the clamped voltage of the first returning circuit (205) is established higher than the maintaining voltage about 10–30 (v) which is converted into primary winding side in order to reduce the initializing time of the ignition transformer (102).

Figure 13:
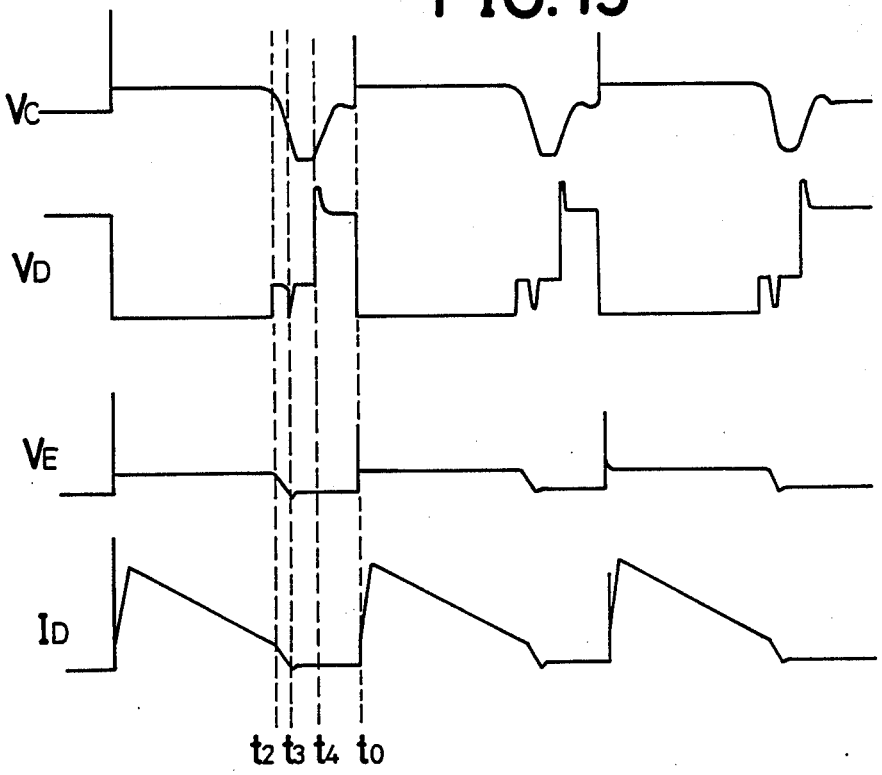
FIG. 13 provides a series of curves showing the voltage and current characteristics at various selected places throughout the circuitry of FIG. 12.

FIG. 13 provides a series of curves showing the voltage and current characteristics at various selected places throughout the circuitry of FIG. 12. As shown in FIG. 13, the spark current ($I_D$) does not flow during the moment ($t_3$) to the moment ($t_0$). Accordingly, in the third embodiment, the period (tb) of the multi vibrator (135) between the moment ($t_3$) and the moment ($t_4$) can be reduced, and thus, the numbers of the sparks during the unit period can be increased.

Figure 14:
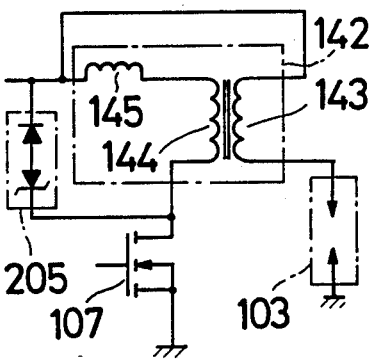
FIG. 14 is a circuit diagram set forth another modified embodiment of this invention.

FIG. 14 is a circuit diagram set forth forth embodiment which modifies second embodiment. In the second embodiment, a high leakage inductance type ignition transformer (142) is utilized instead of the ignition transformer (102) and the choke coil (128). The high leakage inductance type ignition transformer (142) is well known in the art, because the high leakage inductance type ignition transformer is used for the induction type ignition system usually. A detailed explanation for the third embodiment is omitted because the other construction is the same as the second embodiment shown in FIG. 6. The ignition coil (142) which is used for the induction type ignition system has an air gap or the like on the core in order to store magnetic energy as much as possible. Accordingly, the magnetic coupling between the first and second windings is not so good. However, if an amount of the leakage inductance is a proper level, the choke coil (128) can be omitted.

By the way, the total leakage inductance of the ignition transformer (142) is shown as a coil (145) in the FIG. 14.

Figure 15:
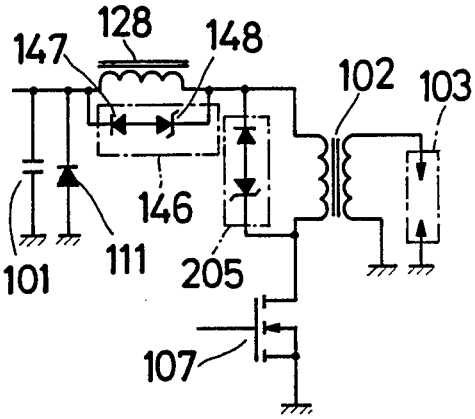
FIG. 15 is a circuit diagram set forth further modified embodiment of this invention.

FIG. 15 is a circuit diagram set forth fifth embodiment which modifies the second embodiment shown in FIG. 6. In the ignition system according to the fifth embodiment, a third returning circuit (146) is added to the second embodiment. The third returning circuit (146) comprises a diode (147) and a zener diode (148), and operates with the first returning circuit (205) together. A detailed explanation for the fifth embodiment is omitted because the other construction of this embodiment is the same as the second embodiment shown in FIG. 6.

In the fifth embodiment, the magnetic energy remained in the ignition transformer (102) and the choke coil (128) is consumed by two independent returning circuits (205) and (146). Therefore, the ignition transformer (102) and the choke coil (128) can be initialized as soon as possible. Accordingly, in this fifth embodiment, numbers of the ignition sparks during the unit period can be increased as much as possible.

Figure 16:
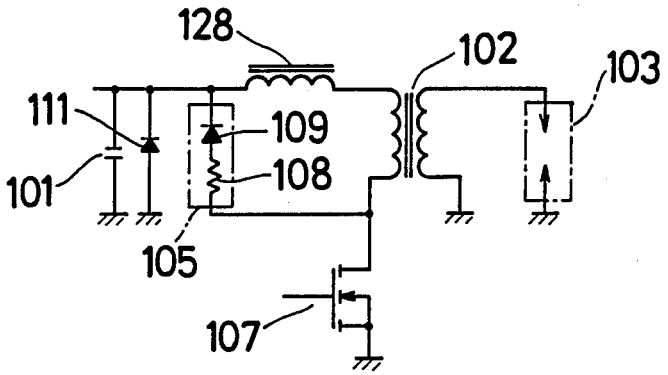
FIG. 16 is a circuit diagram set forth yet further modified embodiment of this invention.

FIG. 16 is a circuit diagram set forth sixth embodiment. In the ignition system according to the sixth embodiment, the first returning circuit (105) which is the same as the first embodiment is connected to the ignition transformer (102) and the choke coil (128) instead of the first returning circuit (205) according to the second embodiment. A detailed explanation is omitted because the other construction is the same as the second embodiment.

As described above, any circuits may be utilized as the first returning circuit (105) or (205) as long as the proper voltage can be defined between both terminals of the first returning circuit.

Various modification may be made in the invention without departing from the scope or spirit of the invention.

What is claimed is:

1. A multi spark ignition system having an ignition capacitor and an ignition transformer, said transformer having primary and secondary windings, said system comprising:

a charging means for charging energy in said ignition capacitor;

discharge switching means having a field effect transistor for discharging said energy in said ignition capacitor through a primary winding of said ignition transformer;

oscillator means for making said discharging switching means operate intermittently with a proper cycle;

controlling means for controlling the consumption of magnetic energy stored in said ignition transformer under non-operative state of said discharge switching means; and first returning means for consuming a magnetic energy stored in said ignition transformer under non-operative state of said discharge switching means;

second returning means for returning said energy stored in said ignition transformer and discharging said energy through said secondary winding under operative state of said discharge switching means; wherein said first returning means is arranged between said second returning means and said discharge switching means.

2. A multi spark ignition system according to claim 1 wherein said charging means further comprises:

DC-DC converting means for generating a high D.C. voltage;

a capacitor means connected to output of said DC-DC converting means; and charge switching means for charging said ignition capacitor in response to operation of said controlling means.

3. A multi spark ignition system according to claim 2 wherein said charging switching means includes a thyristor.

4. A multi spark ignition system according to claim 1 wherein said discharge switching means includes a transistor.

* * * * *